US008910717B2

(12) United States Patent
Mailand et al.

(10) Patent No.: US 8,910,717 B2
(45) Date of Patent: Dec. 16, 2014

(54) FRANGIBLE PRESSURE CONTROL PLUG, ACTUATABLE TOOL INCLUDING THE PLUG, AND METHOD THEREOF

(75) Inventors: Jason C. Mailand, The Woodlands, TX (US); Justin C. Kellner, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 542 days.

(21) Appl. No.: 13/286,775

(22) Filed: Nov. 1, 2011

(65) Prior Publication Data

US 2013/0105175 A1 May 2, 2013

(51) Int. Cl.
*E21B 34/10* (2006.01)
*E21B 34/06* (2006.01)

(52) U.S. Cl.
CPC ..... *E21B 34/06* (2013.01); *E21B 34/063* (2013.01)
USPC ..... 166/374; 166/319; 166/386; 166/317

(58) Field of Classification Search
CPC ..... E21B 34/063; E21B 34/10; E21B 34/103
USPC ..... 166/317, 319, 332.1, 334.4, 374, 373, 166/386
See application file for complete search history.

(56) References Cited

U.S. PATENT DOCUMENTS

| | | | | |
|---|---|---|---|---|
| 443,454 | A | | 12/1890 | Kitsee |
| 3,189,044 | A | | 6/1965 | Sizer |
| 3,662,834 | A | | 5/1972 | Young |
| 3,901,314 | A | * | 8/1975 | Nutter ..... 166/152 |
| 4,330,039 | A | | 5/1982 | Vann et al. |
| 4,718,494 | A | | 1/1988 | Meek |
| 5,035,292 | A | * | 7/1991 | Bailey et al. ..... 175/45 |
| 5,044,444 | A | | 9/1991 | Coronado |
| 5,355,959 | A | | 10/1994 | Walter et al. |
| 5,649,597 | A | | 7/1997 | Ringgenberg |
| 5,810,087 | A | | 9/1998 | Patel |
| 5,950,733 | A | | 9/1999 | Patel |
| 5,954,135 | A | | 9/1999 | Williamson et al. |
| 6,286,594 | B1 | | 9/2001 | French |
| 6,386,289 | B1 | | 5/2002 | Patel |
| 6,550,541 | B2 | | 4/2003 | Patel |
| 6,659,183 | B2 | | 12/2003 | Ward |

(Continued)

OTHER PUBLICATIONS

Baker Hughes Incorporated "FracPoint Openhole Fracture Completion System" Completions and Production, www.bakerhughes.com, 2010, pp. 1-6.

(Continued)

*Primary Examiner* — Brad Harcourt
*Assistant Examiner* — Steven MacDonald
(74) *Attorney, Agent, or Firm* — Cantor Colburn LLP

(57) ABSTRACT

A frangible pressure control plug includes a first portion of a body adjacent a first end of the plug. A second portion of the body adjacent a second end of the plug. The second portion attached to the first portion in a first condition. A groove in the body interposed between the first portion and the second portion. A bore within the body passing through the first end and the first portion and inaccessible from the second end and wherein, fluid communication between the bore and the groove is prevented in the first condition and allowed in a second condition. Also included is a method of actuating a tool.

26 Claims, 4 Drawing Sheets

(56) References Cited

U.S. PATENT DOCUMENTS

| | | | |
|---|---|---|---|
| 7,640,988 | B2 | 1/2010 | Phi et al. |
| 7,913,770 | B2 | 3/2011 | Schramm et al. |
| 2008/0066923 | A1 | 3/2008 | Xu |
| 2010/0236781 | A1 | 9/2010 | Mytopher et al. |
| 2011/0100643 | A1 | 5/2011 | Themig et al. |
| 2012/0006532 | A1* | 1/2012 | Frazier ..... 166/196 |

OTHER PUBLICATIONS

Halliburton "Horizontal Completion Systems", Well Completions Books and Catalogs, Horizontal Systems, www.halliburton.com, Mar. 2011, 1-14.

* cited by examiner

FRANGIBLE PRESSURE CONTROL PLUG, ACTUATABLE TOOL INCLUDING THE PLUG, AND METHOD THEREOF

BACKGROUND

In the drilling and completion industry, the formation of boreholes for the purpose of production or injection of fluid is common. The boreholes are used for exploration or extraction of natural resources such as hydrocarbons, oil, gas, water, and CO2 sequestration. Various downhole tools function therein by actuating specific components while being operated in the borehole. One method of activating a downhole tool is the application of fluid pressure to hydraulic components included in the tool.

One such downhole tool is a pressure actuated sleeve used in a cementing assembly that is responsive to tubing pressure to open a port. When the pressure is built up in the tubing to a certain point, access is provided to a piston on the sleeve that is referenced to a low pressure or atmospheric chamber by breaking a rupture disc. The sleeve can then move to open the port or ports for annulus access. Other types of downhole tools also use pressure operated sleeves that respond to tubing pressure with an associated piston that is open on one side to tubing pressure and on the other side to annulus pressure.

In addition to using a burst disk, downhole tools are held in a deactivated state through the use of either a shear pin, shear screw, shear ring, or seal friction. These methods have limited repeatability, most within +/−5-10 of applied pressure, and therefore do not afford the operation of a well with more accurate pressure actuation windows, posing a problem in wells that have limited casing pressure ratings. Additionally, these prior devices for actuating tools are not changeable by the end user, but will only operate at an "as delivered" pressure, which is not always within acceptable ranges.

Therefore, the art would be receptive to a device and method for actuating tools downhole that provides for more actuation accuracy, while allowing for tuneability to ensure that the device will operate within an acceptable pressure range.

BRIEF DESCRIPTION

A frangible pressure control plug includes a first portion of a body adjacent a first end of the plug; a second portion of the body adjacent a second end of the plug, the second portion attached to the first portion in a first condition; a groove in the body interposed between the first portion and the second portion; and a bore within the body passing through the first end and the first portion and inaccessible from the second end; and wherein, fluid communication between the bore and the groove is prevented in the first condition and allowed in a second condition.

A pressure actuatable tool includes a sleeve having a wall, the sleeve having an aperture through the wall; a frangible pressure control plug plugging the aperture and preventing fluid communication between an interior and an exterior of the sleeve in a first condition, and providing fluid communication between the interior and the exterior of the sleeve in a second condition, the plug including: a first portion of a body adjacent a first end of the plug; a second portion of the body adjacent a second end of the plug, the second portion attached to the first portion in the first condition; a groove in the body interposed between the first portion and the second portion; a bore passing through the first end and the first portion and inaccessible from the second end; and wherein fluid communication between the longitudinal bore and the groove is prevented in the first condition and allowed in a second condition.

A method of actuating a tool using a pressure control plug, the plug including a first portion of a body adjacent a first end of the plug, a second portion of the body adjacent a second end of the plug, the second portion attached to the first portion in a first condition, a groove in the body interposed between the first portion and the second portion, and a bore passing through the first end and the first portion and inaccessible from the second end, the method including inserting the plug in an aperture of a sleeve of the tool, with the second end of the plug facing an interior of the sleeve; increasing pressure within the sleeve and directing the pressure to the groove towards the first portion; and, actuating the tool by applying a critical pressure that fractures the first portion from the second portion in the second condition of the plug to provide fluid access from the sleeve to the groove and bore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
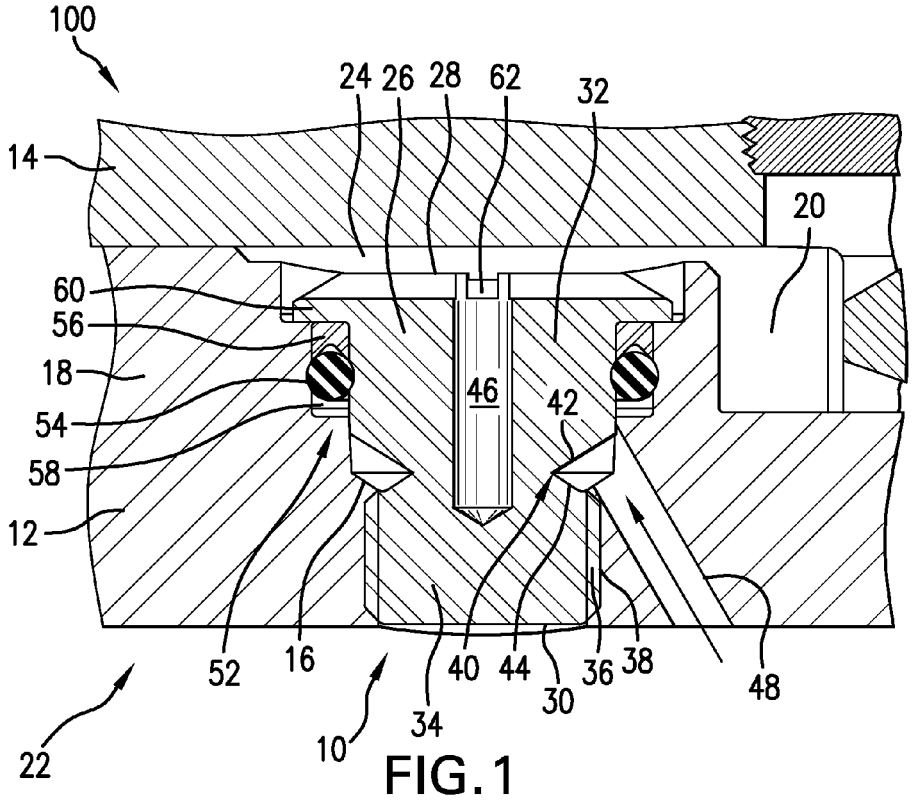
FIG. 1 depicts a cross sectional view of an exemplary embodiment of a pressure control plug in a first condition.
Figure 2:
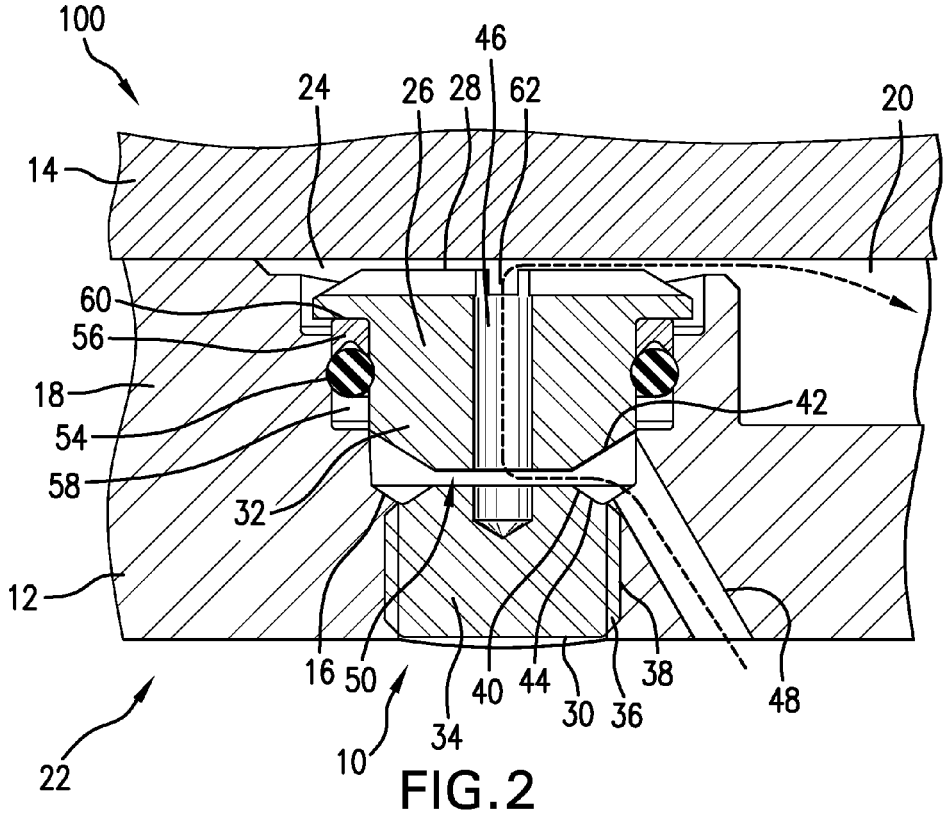
FIG. 2 depicts a cross sectional view of the pressure control plug of FIG. 1 in a second condition.

FIGS. 1 and 2 show an exemplary embodiment of a frangible pressure control plug 10 usable to block and control hydraulic pressure and flow between components, such as between a sleeve 12 and a housing 14 surrounding the sleeve 12, until a critical pressure is reached in order to actuate an actuatable tool 100. Although the pressure control plug 10 is usable within a variety of tools, FIGS. 1 and 2 show the plug 10 inserted within an aperture 16 in a wall 18 of the sleeve 12. In this exemplary tool, the sleeve 12 is positioned within the housing 14 such that an atmospheric pressure chamber 20 is formed between the sleeve 12 and the housing 14. FIG. 1 shows the pressure control plug 10 in a first condition blocking fluid communication between an interior 22 and an exterior 24 of the sleeve 12, and FIG. 2 shows the pressure control plug 10 in a second condition where the plug 10 is fractured and communication is allowed.

The pressure control plug 10 includes a body 26 having a first end 28 and a second end 30. The second end 30 faces an area receiving hydraulic pressure, such as the interior 22 of the sleeve 12. The first end 28 faces away from the area receiving hydraulic pressure. In the exemplary embodiment shown, the first end 28 faces the exterior 24 of the sleeve 12 and the atmospheric pressure chamber 20. A first portion 32 of the body 26 is adjacent the first end 28 and a second portion 34 of the body 26 is adjacent the second end 30. Both the first portion 32 and the second portion 34 may be substantially cylindrically shaped, although other shapes are also usable. The first and second portions 32, 34 may have substantially the same outer diameter, or the first portion 32 may have a larger outer diameter than the second portion 34. The second portion 34 may include threads 36 that mate with threads 38 in the aperture 16 in the sleeve 12. Alternatively, other securement features may be employed on the second portion 34 and the sleeve 12 or other cooperating body for the second portion 34 to be retained therein. If the actuatable tool 100 is a one-time use type tool, the second portion 34 of the plug 10 may even be integrally formed with the tool 100. The first portion 32 is preferably not threaded or at least not threaded into the aperture 16, and the first portion 32 is retained in the aperture 16 via its connection to the second portion 34. The first portion 32 may be integrally formed with the second portion 34, however, in some embodiments, may be otherwise attached to the second portion 34.

A notched groove 40, or other weakened area in the body 26, is interposed between the first and second portions 32, 34. The notched groove 40 preferably circumscribes the plug 10, however it may instead be formed at one or more discrete locations on an outer circumference of the plug 10. In one exemplary embodiment, the groove 40 includes a first face 42 on the first portion 32 and a second face 44 on the second portion 34 intersecting to form a non-zero angle therebetween.

A longitudinal bore 46 passes through the first end 28 and extends through the first portion 26. In an exemplary embodiment, the longitudinal bore 46 is centrally located within the plug 10 by extending along a longitudinal axis of the plug 10. While a single bore 46 is disclosed, in an alternative exemplary embodiment, a plurality of bores may be spaced within the first portion 32. The longitudinal bore 46 passes partially into the second portion 34 of the plug 10, longitudinally past the notched groove 40, however the longitudinal bore 46 does not pass through the second end 30 of the plug 10, and is not accessible from either the second end 30 of the plug 10 or the notched groove 40 in the first condition of the plug 10 shown in FIG. 1. Therefore, when the plug 10 is in place as shown in FIG. 1 in the first condition, fluid communication between the interior 22 of the sleeve 12 and the exterior 14 of the sleeve 12 is prevented. That is, the plug 10 essentially plugs the aperture 16.

As further shown in FIG. 1, pressure from the interior 22 of the sleeve 12, or internal bore pressure, is applied towards the notched groove 40. In the exemplary embodiment shown in FIG. 1, the pressure is applied via a passageway 48 in the sleeve 12 that opens up towards the notched groove 40, and in particular, towards the first face 42 on the first portion 32. As shown in FIG. 2, once a critical pressure is reached, the first portion 32 of the plug 10 separates from the threaded or otherwise secured second portion 34 of the plug 10 and allows hydraulic communication between the first end 28 of the plug 10 and the interior 22 of the sleeve 12 via the longitudinal bore 46, which is intersected by the fracture 50, and the passageway 48. The second condition shown in FIG. 2 occurs when the body 26 of the plug 10 is fractured and a pressure and flow path is created between an interior 22 and exterior 24 of the sleeve 12. The passageway 48, fracture 50, and bore 46 define the pressure and flow path. In an exemplary embodiment, the first portion 32 is longitudinally displaced from the second portion 34, along the longitudinal axis of the plug 10, in the second condition.

The plug 10 can be used to accurately actuate downhole tools 100 in oil and gas wells. The design of the plug 10 allows for more actuation accuracy than other pressure control devices. The notched groove 40 on the frangible pressure control plug 10 can be adjusted during the manufacturing process to give tighter pressure tolerances on the critical fracture pressure. The plug 10 can be either pressure or load tested to determine the correct diameter, depth, and shape of the groove 40 for its intended application, which is a significant benefit to the user. For example, increasing a depth of the notched groove 40 will lower the critical pressure needed to fracture the plug 10 and actuate a tool 100, while decreasing a depth of the notched groove 40 will increase a critical pressure needed to fracture the plug 10 and actuate a tool 100. Decreasing the depth of the groove 40 may be accomplished by adding a filler material therein, or by simply manufacturing a plug 10 having decreased depth. It should be noted that a change in the size of the notched groove 40 need not change the size of the aperture 16 in the sleeve 12, and therefore the pressure rating for actuating the tool 100 may be changed without significant changes to the sleeve 12 or tool 100 itself. Alternatively, while one flow passageway 48 through the sleeve 12 is shown, it should be understood that multiple flow passageways pointing toward the notched groove 40 may be formed in the sleeve 12, or flow passageways having varying diameters and angles may be formed in the sleeve 12, which will also selectively serve to increase or decrease the pressure required to fracture the plug 10.

The body 26 of the plug 10 is made in such a way that the first portion 32 of the plug 10 acts as a hydraulic piston 52 that tries to pull the first portion 32 away from the secured second portion 34. As previously noted, the pressure at which the plug 10 fractures is controlled by the depth or size of the notched groove 40 below the hydraulic piston 52. The bore 46 in the first portion 32 of the body 26 is exposed to the pressure and flow from the passageway 48 via the fracture 50 once the plug 10 is fractured at the notched groove 40. The hydraulic piston 52 is interposed between the fracture 50 and the first end 28 to assist in maintaining the communication between the bore 46 and the passageway 48 established by the fracture 50. An O-ring 54 and a solid (non-cut) backup ring 56 act within a port 58 (in the sleeve 12 for example) to create a net longitudinal force on the first portion 32 of the plug 10 with the application of pressure exteriorly of the second end 30 of the second portion 34. The O-ring 54 and backup ring 56 surround a periphery of the first portion 32 of the body 26 and abut and press on a lip 60 of the first portion 32 of the body 26 that protrudes from the first portion 32 of the body 26 adjacent the first end 28 of the body 26. The backup ring 56 is interposed between the O-ring and the lip 60. The O-ring may be an elastomeric sealing ring. The plug 10 has been designed such that only a small longitudinal displacement of the first portion 32 from the second portion 34 will allow full flow through the plug 10, such that the O-ring 54 and backup ring 56 do not need to be completely expelled from the port 58 for full communication flow to be established through the fracture 50 as shown in FIG. 2.

In an exemplary embodiment, the first end 28 of the body 26 includes a seal preventer designed to prevent the plug 10 from making any type of seal against anything that it hits when the plug 10 fractures and the first portion 32 is moved longitudinally. The seal preventer ensures that even if a surface of the first end 28 of the body 26 hits the housing 14, it will not form a seal with the housing 14 and will not prevent fluid communication from the bore 46 to the exterior 24. As shown in FIGS. 1 and 2, the seal preventer is a cross-slot 62 intersecting a surface of the first end 28 at a location where the bore 46 opens to the first end 28. However, alternative embodiments of the seal preventer may include, but are not limited to, one or more protrusions, indentations, slots, or a combination of these features, and such features, including the cross-slot 62, may extend across a surface of the first end 28. Alternatively, the portion of the housing 14 facing the first end 28 of the body 26 may include the seal preventer, or both the plug 10 and the housing 14 may include seal preventing features.

In the embodiment shown in FIGS. 1 and 2, the plug 10 is placed in the aperture 16 of the sleeve 12, and the aperture 16 is in communication with the angled passageway 48 that is also formed in the sleeve 12. FIGS. 3A-3B, 4A-4B, and 5A-5B, show alternate embodiments for directing fluid pressure from the sleeve 12 towards the notched groove 40 of the plug 10. In each of these alternate embodiments, the communication is provided on or within the plug itself rather than within the sleeve 12.

Figure 3A:
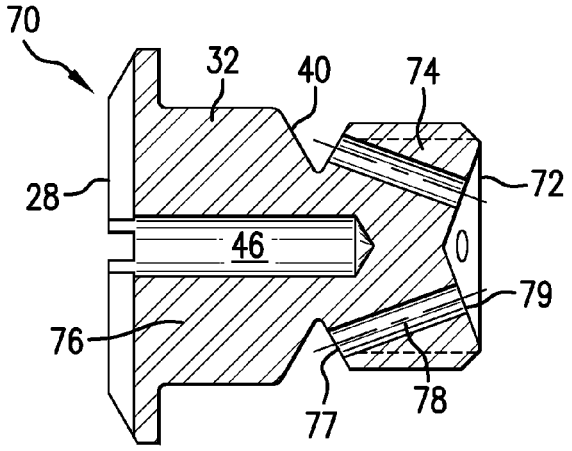
FIGS. 3A and 3B depict a cross sectional view and a perspective view, respectively, of another exemplary embodiment of a pressure control plug in a first condition.
Figure 3B:
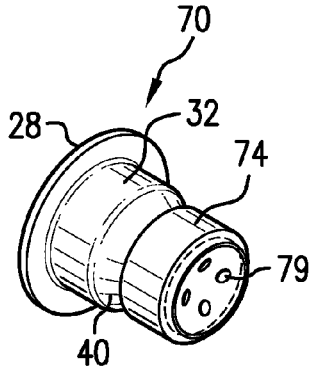

In FIGS. 3A-3B, a frangible pressure control plug 70 includes first end 28, second end 72, first portion 32, and second portion 74 of a body 76. Angled communication passageways 78 are drilled or otherwise formed through the second portion 74 of the body 76 from the second end 72 to the notched groove 40. While four passageways 78 are shown in FIG. 3B, any number may be included. The second portion 74 may be threaded as shown in FIGS. 1 and 2, or may include alternate securement features that engage with an aperture 16 in a sleeve 12 of an actuatable tool 100, as shown in FIG. 1. A first end 77 of the passageway 78 directs fluid into the notched groove 40 while a second end 79 of the passageway 78 is accessible from the second end 72 of the body 76.

Figure 4A:
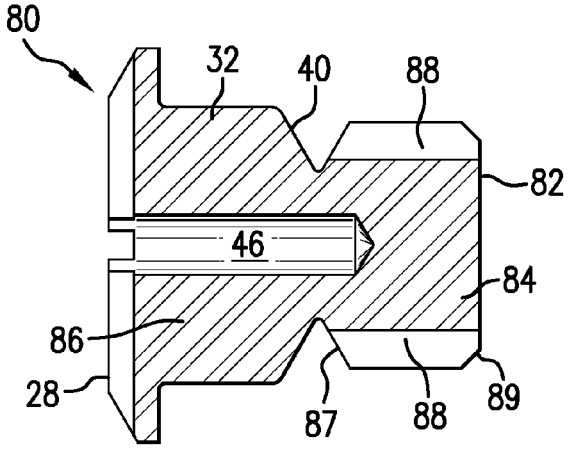
FIGS. 4A and 4B depict a cross sectional view and a perspective view, respectively, of still another exemplary embodiment of a pressure control plug in a first condition.
Figure 4B:
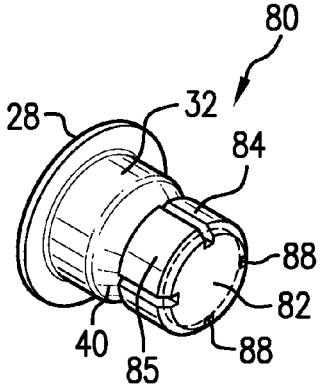

In FIGS. 4A-4B, a frangible pressure control plug 80 includes first end 28, second end 82, first portion 32, and second portion 84 of a body 86. Slots 88 are longitudinally cut through a side surface 85 of the second portion 84 of the body 86 from the second end 82 to the notched groove 40. While four slots 88 are shown in FIG. 4B, any number may be included. The second portion 84 may be threaded as shown in FIGS. 1 and 2, in which case the slots 88 intersect the threads. The second portion 84 may alternatively include other securement features that engage with an aperture 16 in a sleeve 12 of an actuatable tool 100, as shown in FIG. 1. A first end 87 of the slot 88 directs fluid into the notched groove 40 while a second end 89 of the slot 88 is accessible from the second end 82 of the body 86. Although the slot 88 is open on a side thereof, when the plug 80 is inserted in an aperture 16, only the first end 87 and the second end 89 of the slot 88 are opened. That is, a sidewall of the aperture 16, as shown in FIG. 1, forms a side for the slot 88 to form a passageway from the second end 82 of the body 86 to the notched groove 40.

Figure 5A:
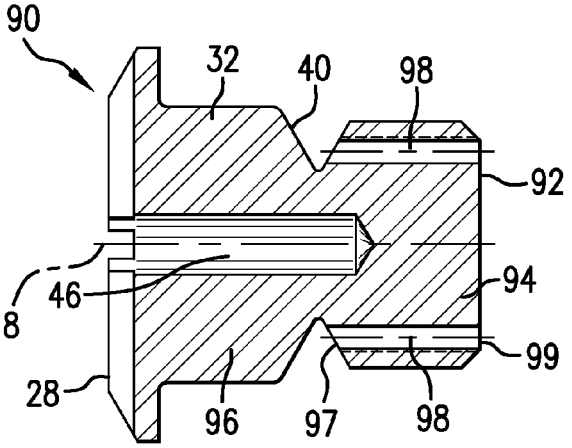
FIGS. 5A and 5B depict a cross sectional view and a perspective view, respectively, of yet another exemplary embodiment of a pressure control plug in a first condition.
Figure 5B:
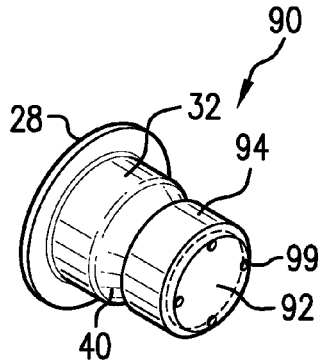

In FIGS. 5A-5B, a frangible pressure control plug 90 includes first end 28, second end 92, first portion 32, and second portion 94 of a body 96. Communication passageways 98 that run substantially parallel to, but off-axis from, the longitudinal axis 8 of the plug 90 are drilled or otherwise formed through the second portion 94 of the body 96 from the second end 92 to the notched groove 40. As in FIGS. 3A-3B, the passageways 98 are formed within the second portion 94 within an interior of the second portion 94, so as not to interfere with threads (not shown) thereon as in FIGS. 4A-4B. While four passageways 98 are shown in FIG. 5B, any number may be included. The second portion 94 may be threaded as shown in FIGS. 1 and 2, or may include alternate securement features that engage with an aperture 16 in a sleeve 12 of an actuatable tool 100. A first end 97 of the passageway 98 directs fluid into the notched groove 40 while a second end 99 of the passageway 98 is accessible from the second end 92 of the body 96.

Thus, the frangible pressure control plug 10, in any of its various embodiments or combinations thereof, provides an improved alternative to other conventional methods of actuating tools downhole including shear pins, shear screws, shear rings, and burst disks. All of these other methods have limited repeatability, most within +/−5 to 10 of applied pressure and are not tuneable or changeable. The frangible pressure control plug 10 described herein is infinitely tuneable via dimension changes to its notched groove 40, and thus provides an accurate actuation of downhole tools.

Figure 6:
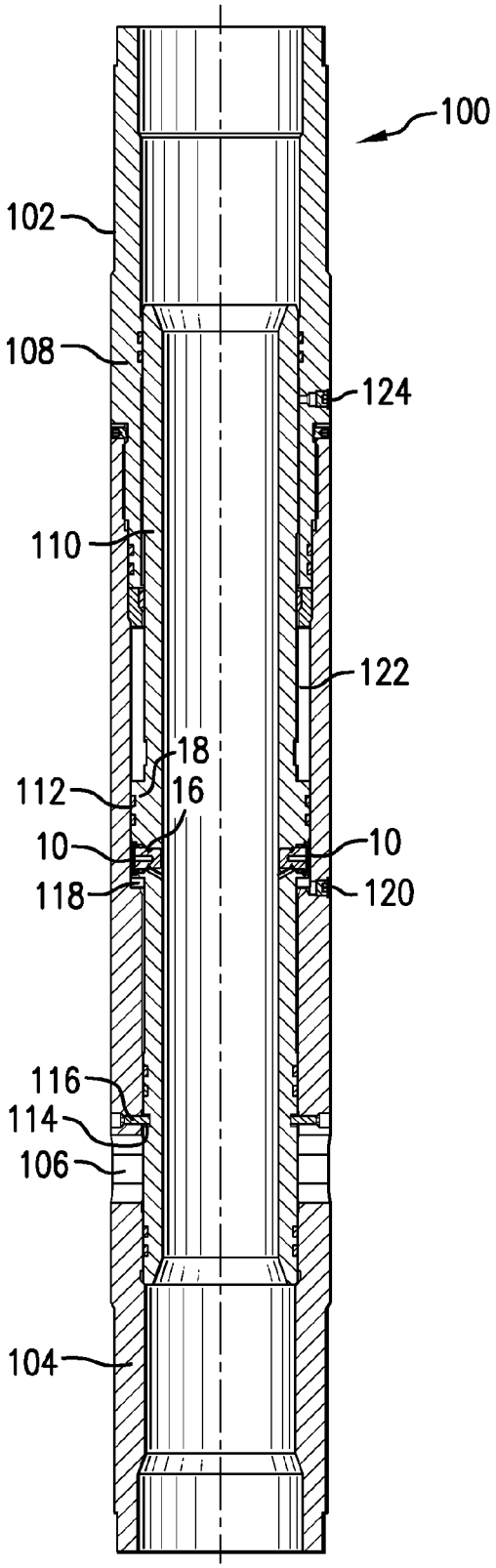
FIG. 6 depicts a cross sectional view of an exemplary embodiment of a valve incorporating the pressure control plug of FIG. 1 in the first condition and a sleeve in a ports closed position; and, FIG. 7A depicts a cross sectional view of the valve of FIG. 6 with the sleeve in a ports open position, and the pressure control plug of FIG. 2 in the second condition.
Figure 7A:
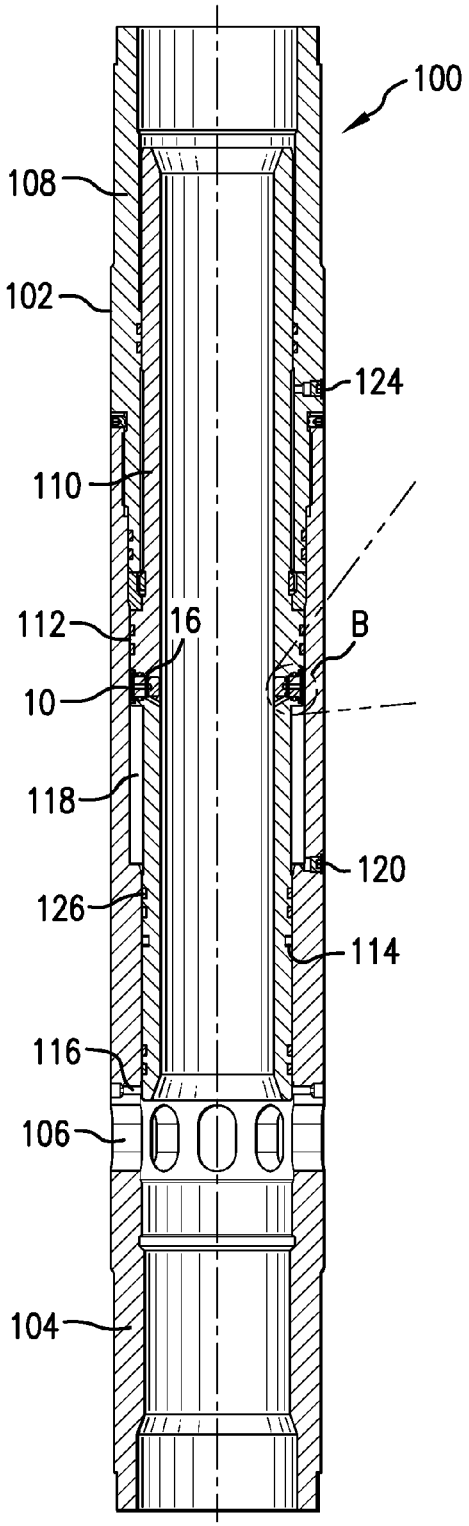
FIG. 7B depicts an enlarged view of area B of FIG. 7A.
Figure 7B:
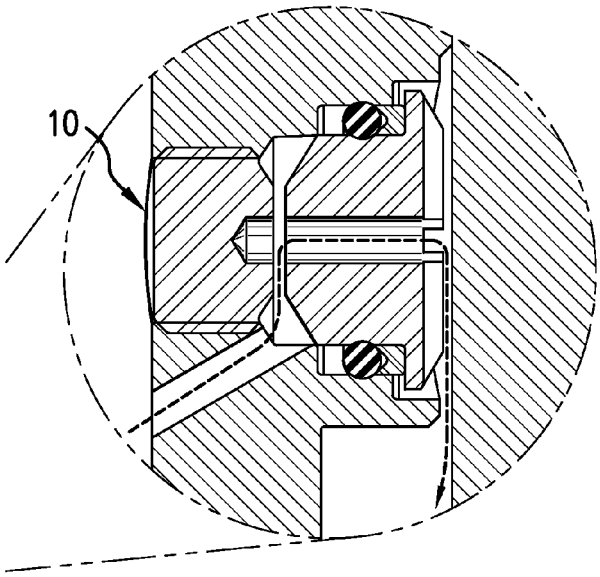

Turning now to FIGS. 6 and 7A and 7B, one exemplary embodiment of an actuatable tool 100 that employs the pressure control plug 10 is shown. The actuatable tool 100 is similar to that described in U.S. patent application Ser. No. 13/193,902 entitled "Pressure Actuated Ported Sub for Subterranean Cement Completion" filed on Jul. 29, 2011, herein incorporated by reference, except that the tool 100 shown in FIGS. 6 and 7A and 7B employs the pressure control plug 10 instead of a burst disk. The tool 100 is a valve 102 that is run in open-hole cementable completions just above float equipment. FIG. 6 shows the valve 102 in a closed position, where the pressure control plug 10 is in the first condition as shown in FIG. 1, and FIG. 7A shows the valve actuated to an open position, where the pressure control plug 10 of section B is in the second condition as shown in FIG. 2, and in FIG. 7B. The valve 102 includes a ported housing 104, having fluid communication ports 106, and body 108. Between the ported housing 104 and the body 108 is captured an inner shifting sleeve 110. Internal bore piston seals 112 are used to drive down the inner shifting sleeve 110 within the ported housing 104, once the pressure control plug 10 is fractured. The inner shifting sleeve 110 also has a shoulder 114 that shears the shear screws 116 during the opening shift of the inner sleeve 110.

A first atmospheric chamber 118 contains air that can be independently tested through a first pressure test port 120, while a second atmospheric chamber 122 also contains air that can be independently tested through a second pressure testing port 124. The pressure control plug 10 is held into place within an aperture 16 located in a wall 18 of the inner shifting sleeve 110.

The valve 102 is run on casing and cemented into place within the well. After cementation the valve 102 is scraped with wiper dart prior to actuation. Once the cement has set on the outside of the valve 102, it is ready to be opened with a combination of high hydrostatic and applied pressure. Once the critical pressure is reached, the pressure control plug 10 is fractured and opens the first atmospheric chamber 118 to the applied pressure. This pressure acts on the piston area created by internal bore piston seals 126 and larger internal bore piston seals 112 and drives the inner shifting sleeve 110 to compress the air within the atmospheric chamber 122 and open the fluid communication ports 106 on the ported housing 104. Chamber 122 has an initial pressure of atmospheric or a predetermined value less than the anticipated hydrostatic pressure within sleeve 110. The volume of chamber 122 decreases and its internal pressure rises as sleeve 110 moves to open ports 106. The valve 102 includes a plurality of the pressure control plugs 10.

While one exemplary tool has been shown and described, it should be understood that the pressure control plug 10 is usable in any of a number of actuatable tools.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A frangible pressure control plug comprising:

a first portion of a body adjacent a first end of the plug;

a second portion of the body adjacent a second end of the plug, the second portion attached to the first portion in a first condition;

a groove in the body interposed between the first portion and the second portion;

a bore within the body passing through the first end and the first portion and inaccessible from the second end; and a hydraulic piston between the first end and the groove;

wherein, fluid communication between the bore and the groove is prevented in the first condition and allowed in a second condition.

2. The pressure control plug of claim 1, wherein the second condition occurs at a critical pressure applied to the groove towards the first portion.

3. The pressure control plug of claim 1, wherein the first portion is longitudinally displaced from the second portion in the second condition.

4. The pressure control plug of claim 1, wherein the first end includes a seal preventer.

5. The pressure control plug of claim 4, wherein the seal preventer is a slot in communication with the bore.

6. The pressure control plug of claim 1, wherein the bore longitudinally extends through the first portion and passed a longitudinal position corresponding to the groove.

7. The pressure control plug of claim 1, wherein the body includes a lip protruding from the first portion and the hydraulic piston includes at least one ring abutting the lip.

8. The pressure control plug of claim 7, wherein the at least one ring includes an O-ring.

9. The pressure control plug of claim 8, wherein the at least one ring includes a backup ring interposed between the O-ring and the lip.

10. A frangible pressure control plug comprising:

a first portion of a body adjacent a first end of the plug;

a second portion of the body adjacent a second end of the plug, the second portion attached to the first portion in a first condition;

a groove in the body interposed between the first portion and the second portion; and, a bore within the body passing through the first end and the first portion and inaccessible from the second end;

wherein, fluid communication between the bore and the groove is prevented in the first condition and allowed in a second condition, and wherein the second portion is threaded and the first portion is not threaded.

11. The pressure control plug of claim 1, wherein the groove circumscribes the plug.

12. The pressure control plug of claim 1, further comprising a fluid passageway formed in the second portion and directed towards the groove.

13. The pressure control plug of claim 12, wherein the fluid passageway is at least one bore passing through the second end and opening towards the groove.

14. The pressure control plug of claim 12, wherein the fluid passageway is at least one slot intersecting an edge of the second portion and opening towards the groove.

15. The pressure control plug of claim 14, wherein the edge of the second portion is threaded.

16. A pressure actuatable tool comprising:

a sleeve having a wall, the sleeve having an aperture through the wall;

a frangible pressure control plug plugging the aperture and preventing fluid communication between an interior and an exterior of the sleeve in a first condition, and providing fluid communication between the interior and the exterior of the sleeve in a second condition, the plug including:

a first portion of a body adjacent a first end of the plug;

a second portion of the body adjacent a second end of the plug, the second portion attached to the first portion in the first condition;

a groove in the body interposed between the first portion and the second portion;

a bore passing through the first end and the first portion and inaccessible from the second end; and wherein fluid communication between the longitudinal bore and the groove is prevented in the first condition and allowed in a second condition, and wherein a critical fluid pressure in the interior of the sleeve moves the first portion away from the second portion in the second condition.

17. The pressure actuatable tool of claim 16, wherein the first end of the plug faces an exterior of the sleeve and a second end of the plug faces an interior of the sleeve.

18. The pressure actuatable tool of claim 17, wherein the sleeve includes a passageway that directs fluid pressure from an interior of the sleeve to the groove and towards the first portion.

19. A pressure actuatable tool comprising:

a sleeve having a wall, the sleeve having an aperture through the wall;

a frangible pressure control plug plugging the aperture and preventing fluid communication between an interior and an exterior of the sleeve in a first condition, and providing fluid communication between the interior and the exterior of the sleeve in a second condition, the plug including:

a first portion of a body adjacent a first end of the plug;

a second portion of the body adjacent a second end of the plug, the second portion attached to the first portion in the first condition;

a groove in the body interposed between the first portion and the second portion; and, a bore passing through the first end and the first portion and inaccessible from the second end;

wherein fluid communication between the longitudinal bore and the groove is prevented in the first condition and allowed in a second condition and wherein the aperture includes a securement feature for retaining the second portion and not the first portion.

20. The pressure actuatable tool of claim 19, wherein the securement feature is threads, and the second portion includes threads that matingly engage with the threads of the aperture.

21. The pressure actuatable tool of claim 16, further comprising a hydraulic piston surrounding the first portion, the aperture including a port surrounding the first portion.

22. The pressure actuatable tool of claim 16, further comprising a housing surrounding the sleeve, wherein at least one of the plug and the housing includes a seal preventer preventing sealing of the first end of the plug to the housing in the second condition.

23. A method of actuating a tool using a pressure control plug, the plug including a first portion of a body adjacent a first end of the plug, a second portion of the body adjacent a second end of the plug, the second portion attached to the first portion in a first condition, a groove in the body interposed between the first portion and the second portion, and a bore passing through the first end and the first portion and inaccessible from the second end, the method comprising:

inserting the plug in an aperture of a sleeve of the tool, with the second end of the plug facing an interior of the sleeve;

increasing pressure within the sleeve and directing the pressure to the groove towards the first portion; and, actuating the tool by applying a critical pressure that fractures the first portion from the second portion in the second condition of the plug to provide fluid access from the sleeve to the groove and bore.

24. The method of actuating a tool as claimed in claim 23, further comprising:

changing a size of the groove to alter the critical pressure that the second condition will occur.

25. The method of actuating a tool as claimed in claim 23 wherein inserting the plug in the aperture includes threading the second portion into the aperture.

26. The method of actuating a tool as claimed in claim 23, wherein inserting the plug in the aperture further comprises surrounding the first portion with a hydraulic piston.

* * * * *